United States Patent [19]

Nemeth

[11] 4,244,267

[45] Jan. 13, 1981

[54] PERCUSSION INSTRUMENT

[76] Inventor: James J. Nemeth, 995 Summit Dr., Laguna Beach, Calif. 92651

[21] Appl. No.: 26,579

[22] Filed: Apr. 3, 1979

[51] Int. Cl.[3] ..... G10D 13/02

[52] U.S. Cl. ..... 84/418; 84/421

[58] Field of Search ..... 84/418, 422, 421, 402, 84/403

[56] References Cited

U.S. PATENT DOCUMENTS

| | | | |
|---|---|---|---|
| 2,458,193 | 1/1949 | Packheiser | 84/403 |
| 3,215,020 | 11/1965 | Kester | 84/422 X |
| 3,481,239 | 12/1969 | Blumenfeld | 84/418 |
| 3,657,465 | 4/1972 | Koishikawa | 84/418 |
| 3,675,528 | 7/1972 | Brick | 84/418 |

FOREIGN PATENT DOCUMENTS

| | | | |
|---|---|---|---|
| 168806 | 7/1905 | Fed. Rep. of Germany | 84/422 |

*Primary Examiner*—Lawrence R. Franklin

*Attorney, Agent, or Firm*—G. Donald Weber, Jr.

[57] ABSTRACT

There is described a percussion instrument which is adapted to be used with a drum apparatus, for example, to provide additional sound effects therewith. The instrument comprises a generally ring shaped member and is arranged to support sound producing elements such as cymbals, shakers or the like. A suspension arrangement is provided wherein the ring-like member can be suspended or supported at the drum apparatus with varying degrees of resiliency so that the rate, period and tone of the sound produced by the instrument can be varied.

12 Claims, 7 Drawing Figures

PERCUSSION INSTRUMENT

BACKGROUND OF THE INVENTION

1. Field of the Invention

The invention relates generally to a sound producing percussion instrument, in general, and to such an instrument which produces sounds in accordance with the operation of a drum (or the like) with a selectively variable tonal quality, in particular.

2. Prior Art

The prior art comprises many percussion instruments and many combinations thereof to effect varying sounds, tonal qualities and sound combinations. For example, in many cases drums, for example, are arranged to include therewith appropriate cymbal arrangements. These cymbal arrangements can be operated by means of a foot pedal or the like whereby the cymbals are selectively brought together to produce cymbal sound. While the operator of the instrument may obtain different sound patterns as a function of his skill in operating the instrument, nevertheless, the sounds are very similar and variations therein are difficult to achieve.

Another instrument used in percussion is a tambourine which, effectively, includes a ring with small cymbals arranged thereon. In the known tambourines, the ring may be independent or, conversely, a membrane may be stretched across one side thereof so that the tambourine may be selectively struck by the user thereof. The tambourine produces a different type of sound from the cymbal arrangement discussed above and is frequently desired in a percussion rendition of a musical score. However, the tambourines which are known in the art require the user to hold the tambourine and shake or hit the instrument to produce a sound. This requirement, of course, forces the user to have one hand occupied which substantially precludes concurrent drumming or other percussion instrument operation. Moreover, the sound produced by the tambourine is very difficult to reproduce accurately in normal operation.

Many renditions of musical scores require that the tambourine sound be produced and reproduced in a repetitive fashion. This type of sound producing quality is not available through the currently known devices.

PRIOR ART

A search of the prior art has not yet been conducted. However, the tambourine and cymbal arrangements noted in the Background are the closest prior art known to applicant.

SUMMARY OF THE INVENTION

The invention comprises a musical instrument of the percussion variety which includes on outer ring member for supporting sound or tone producing elements such as cymbals, enclosed beads or the like. A selectively adjustable, resilient support mechanism is associated with the outer ring member. The support mechanism includes resilient means adjustably fastened to the ring and secured in a hub which permits the mounting of the instrument on known and existing apparatus associated with percussion instruments such as drums and the like.

DESCRIPTION OF A PREFERRED EMBODIMENT

Figure 1:
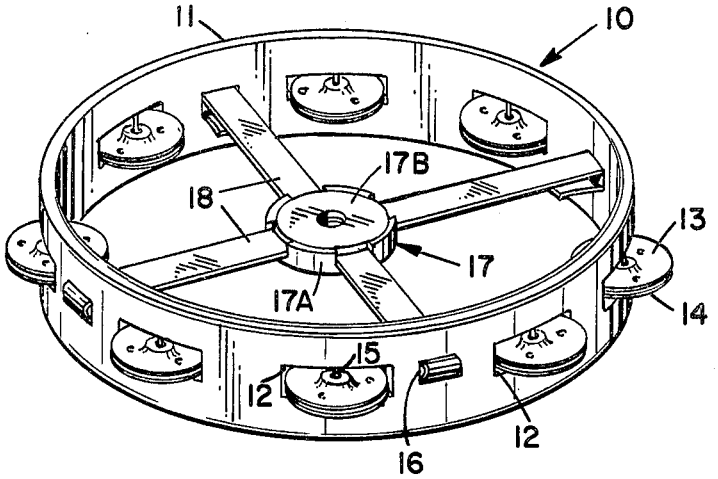
FIG. 1 is a perspective view of the percussion instrument of the instant invention.
Figure 2:
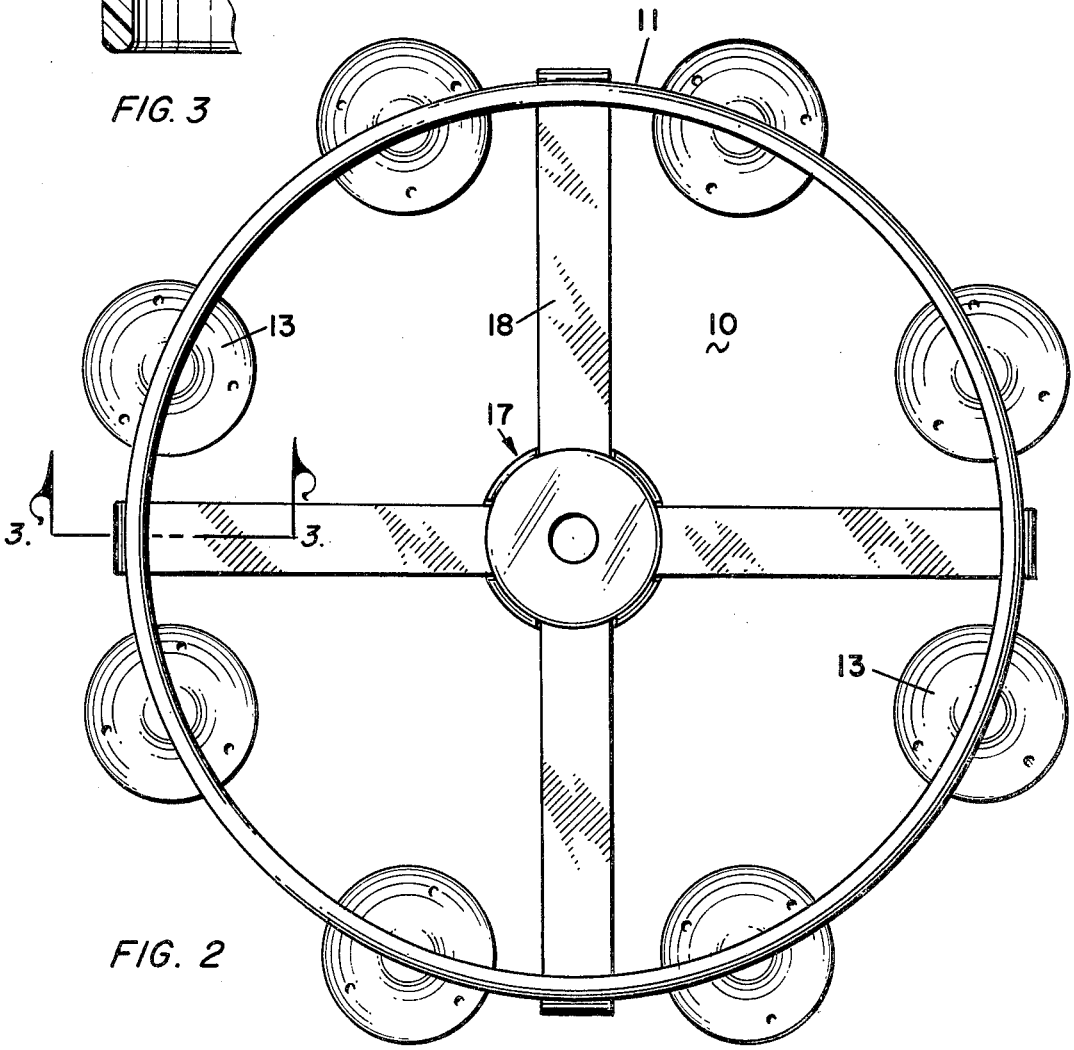
FIG. 2 is a top view of the percussion instrument of the instant invention.

Referring concurrently now to FIGS. 1 and 2, there is shown a perspective view of percussion instrument 10 which forms the instant invention. Instrument 10 comprises an outer ring member 11 which can be fabricated of any suitable material such as, but not limited to, an acrylic plastic or the like. While not so limited, ring 11 may have a diameter of approximately ten inches. The height from the top to bottom edge of ring 11 may be on the order of approximately 1½ inches. Of course, the dimensions are not limitative of the invention. A plurality of apertures 12 are formed in and through the surface of ring 11. Each of the apertures is adapted to receive a pair of metal disks or jingles 13 and 14. The upper jingles 13 and the lower jingles 14 in a related pair are arranged such that they can strike against each other to produce the desired sound. Each pair of jingles or cymbals is mounted on a suitable pin or axle 15 which is fixed in ring 11 and passes through central apertures in cymbals 13 and 14. In addition, a plurality of apertures 16 are formed in ring 11 for providing the selectively adjustable engagement between ring 11 and the support mechanism (described hereinafter relative to FIG. 3.)

Figure 4:
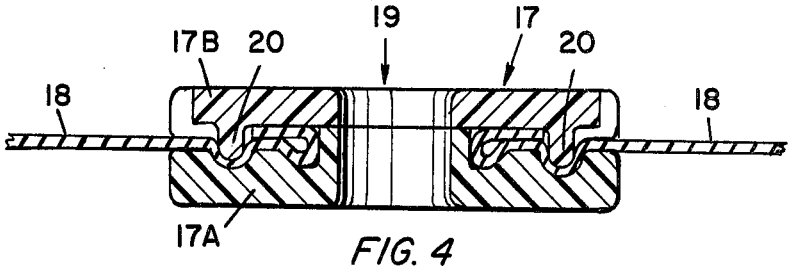
FIG. 4 is a cross sectional view of the hub shown in FIG. 2.

The support mechanism includes hub 17 which comprises upper member 17B and lower member 17A each of which has a central aperture therethrough and is described in relation to greater detail in FIG. 4. A plurality of resilient support members 18 are interconnected between ring 11 and hub 17 to provide the resilient support arrangement therefor. In a typical embodiment, resilient members 18 can be formed of a suitable rubber or other resilient material which can be selectively stretched or otherwise altered such that the resiliency thereof is modified. This modification permits modified operation of the percussion instrument 10.

Figure 3:
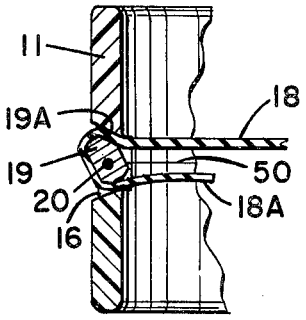
FIG. 3 is a section view along the lines 3—3 in FIG. 2 which shows the adjustable connection apparatus for joining the outer ring and the support structure.

Referring now to FIG. 3, there is shown a cross sectional view of the connection arrangement for connecting the support mechanism to the outer ring. In this FIGURE, aperture 16 in ring 11 is more clearly shown. It is seen that aperture 16 includes sloped or champfered edges which define an aperture having a smaller dimension at the inner surface of ring 11 than at the outer surface. In addition, pivotal lock member 19 is shown mounted in aperture 16 and pivotally mounted at pivot pin 20. Member 19 includes a champfered edge 19A. Resilient member 18 is shown passing through aperture 16 adjacent the upper end of lock member 19, being reversed upon itself, and being returned through aperture 16 at the bottom of lock member 19. The end 18A of support member 18 is freely available for adjustment by merely pulling thereon. With this arrangement of the locking mechanism, pulling on end 18A causes lock member 19 to pivot counter-clockwise (in this illustration) so that support member 18 passes through aperture 16 to left at the upper portion and to the right at the bottom portion in this illustration. When end 18A is released, member 18 attempts to retract through aperture 16. However, this action causes lock member 19 to pivot in the clockwise direction (in this illustration) wherein support member (or strap) 18 is now pinched between surface 19A of lock member 19 and the champfered surface of aperture 16 in ring 11. Consequently, by adjustment of end 18A, the appropriate resiliency, tension and the like of support strap 18 is provided.

It should be noted that the procedure can be reversed by manually pivotally lock member 19 in the counter-clockwise direction and permitting strap 18 to slide between surface 19A and the champfered surface of ring 11 until a suitable position for the strap is achieved.

Referring now to FIG. 4 there is shown a cross-sectional view of hub 17. As noted above, bub 17 comprises lower member 17A and upper member 17B which mate together and clamp the ends of support straps 18. It is seen that central aperture 19 passes through hub 17 and each of the parts thereof.

Upper member 17B has a generally planar upper surface and a lower surface which includes projection 20 which interlocks as described hereinafter. Projection 20 may be a plurality of projections or, conversely, may be in a form of an annular lip or ring around the edge of member 17B.

Lower portion 17A includes a depression which is arranged to receive projection 20 from member 17B. In addition, in this embodiment, member 17A includes a depressed portion for receiving the end of strap 18 which can be curled around and returned on itself to form a loop which is readily retained within hub 17. As is best seen in FIG. 1, lower member 17A includes an outer wall or surface which extends to the upper surface of upper member 17B by which the new members are fastened together through sonic welding, suitable glue or the like. However, as shown in FIG. 4, spaces are provided in the outer wall through which the support strap 18 extend.

Hub 17 in conjunction with flexible, resilient support straps 18 provides a unique support mechanism. The support mechanism is adjustable by applying appropriate tension to straps 18 through the operation of altering the length thereof. With this support mechanism, the resiliency of the instrument can be altered so that the vibration, period and rate movement can be controlled. For example, if straps 18 are quite loose, then a lower rate of operation is produced for the instrument and the sound producing qualities thereof are changed relative to a situation wherein straps 18 are stretched taut and provide a more rapid rate of movement. The hub 17 permits ready access to the support structure by providing a relatively inexpensive but compact and uncomplicated means for joining the strap ends together. Consequently, the hub and strap apparatus provides a highly unique support apparatus.

Figure 5:
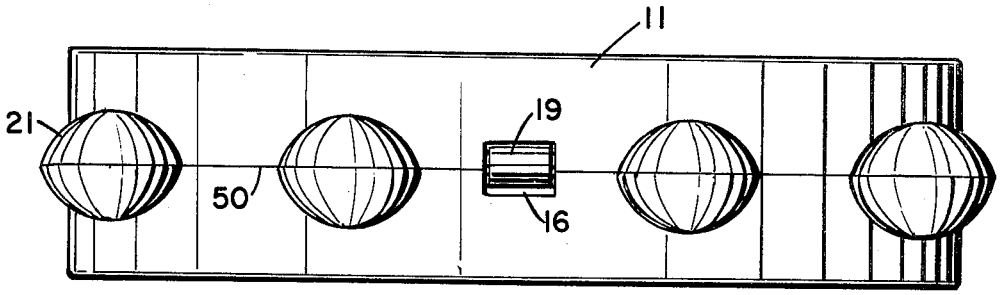
FIG. 5 is a side view of another embodiment of the instant invention.

Turning now to FIG. 5, there is shown an elevation view of another embodiment of the invention. In FIG. 5, outer ring 11 is provided similar to the embodiment shown in FIG. 1. Again, apertures 16 and pivot members 19 are provided. Strap 18 is omitted in FIG. 5 for purposes of clarity.

Figure 6:
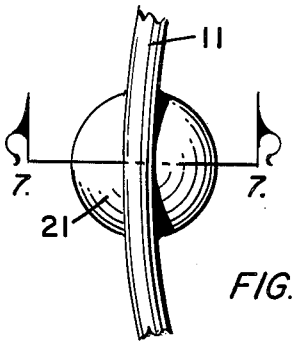
FIG. 6 is a top view of a portion of the embodiment shown in FIG. 5.

In the embodiment shown in FIG. 5, apertures 12 and the cymbal members are also omitted and a different sound producing mechanism is provided. As shown in FIGS. 5 and 6, a plurality of hemispherical elements 21 are provided. These elements are provided on the inner, outer or both surfaces of ring 11. In the embodiment shown in FIG. 6, the hemispherical elements are provided on both sides of the ring.

Figure 7:
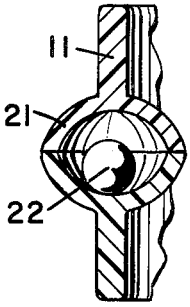
FIG. 7 is a cross sectional view of the detailed drawing shown in FIG. 6.

Referring now to FIG. 7 there is shown a cross-sectional view of the hemispherical device 21 taken along the lines of 7—7 in FIG. 6. This sectional view shows that the hemispherical elements 21 are substantially hollow and contain one or more beads 22 of a suitable nature such as glass, metal or the like. This embodiment has the effect of producing a sound produced by shakers such as are frequently found in gourds or the like. In the embodiment shown, the cymbal members have been replaced on a 1-for-1-basis. However, the hemispherical elements (as well as the cymbals) can be arranged to have any number which is deemed desirable for the particular instrument.

While several methods of fabrication may be appropriate it is noted that ring 11 (regardless of the embodiment involved) can be formed as the combination of an upper and lower ring portion. The upper and lower ring portions would be substantially identical in configuration and be joined at the line 50 as shown in either FIGS. 3 or 5. In this case, the ring portions include horizontal slots in the edges thereof adjacent to aperture 16 to receive pivot pin 20 for locking member 19. Likewise, in the embodiment shown in FIG. 1, a vertical hole in the edge of aperture 12 is arranged to receive axle pin 15 to support cymbals 13 and 14. In the embodiment shown in FIG. 5, this pin slot is omitted but the hemisphere portions would be mated together. When the device has been assembled, (i.e. bead 22, or pins 15 and 19 with cymbals 13 and 14, depending upon the embodiment, are in place,) the mated together upper and lower ring portions can then be joined together by any suitable adhesive including sonic welding in the case of a plastic ring 11. Of course, any suitable method of effecting the joinder is contemplated.

Thus, there has been shown a new and unique percussion instrument which includes a new and unique supporting apparatus therein. The instrument has been described in terms of two embodiments for producing different types of sounds. It is contemplated that other sound producing elements or components can be provided at ring 11. For example, bells can be inserted in the place of the elements illustrated. The instrument is not limited only to the two embodiments shown or described but is intended to incorporate any sound or tone producing element which could be assembled with the instrument as described. Suitable dimensions and configurations have also been shown or described. However, other dimensions are clearly possible and modified configurations of the sound producing members can be established. For example, the size and shape of the hemisphere portions can be varied (e.g. elongated pod-like members) as well as the number of beads included therein. Also, it is noted the number of sound producing elements and the disposition around the periphery of the ring can also be varied depending upon desired requirements.

The hub and support apparatus permits a unique apparatus for supporting a percussion instrument, among other things. The support mechanism permits easy modification and change of the support characteristics, and, thus, the operational characteristics of the instrument which is being supported. While the support apparatus has been shown to include four support straps, any other suitable or desirable number can be utilized. In addition, while the straps have been defined to be of rubber or similar material, other suitable resilient material can be utilized as well.

It should be noted that the description presented herewith is intended to be illustrative of the invention only and not intended to be limitative thereof. Rather, the scope of the application is limited only by the claims appended hereto.

Having thus described the preferred embodiment of the invention, what is claimed is:

1. A percussion instrument comprising,
an outer ring member,
a plurality of sound producing elements attached to said ring member,
at least one resilient means engaged with and spanning the interior of said ring member, and
hub means connected to said resilient means within said ring member and adapted to coact with a separate mounting means to to provide a mounting arrangement for said percussion instrument.

2. The percussion instrument recited in claim 1 wherein:
said ring member includes apertures therein for receiving said sound producing elements.

3. The percusssion instrument recited in claim 1 wherein:
said sound producing elements include cymbal means.

4. The percussion instrument recited in claim 1 wherein,
said hub means includes upper and lower body members which engage each other and lock said resilient means therein.

5. The percussion instrument recited in claim 4 wherein:
one of said upper and lower body members includes a projection from the surface thereof which mates with a depression in the surface of the other.

6. The percussion instrument recited in claim 1 wherein:
said ring member includes a locking mechanism for receiving said resilient means.

7. The percussion instrument recited in claim 6 wherein:
said locking mechanism includes a pivotally mounted member in an aperture in said ring member such that said resilient means is disposed around said pivotally mounted member within said aperture.

8. The percussion instrument recited in claim 1 wherein:
each of said sound producing elements includes a substantially hollow member having at least one movable element therein.

9. The percussion instrument recited in claim 1 wherein:
said resilient means includes a selectively adjustable, flexible strap member.

10. The percussion instrument recited in claim 9 wherein,
said flexible strap member is formed of rubber, and
said outer ring member is fabricated of a plastic.

11. The percussion instrument recited in claim 9 wherein,
said flexible strap member spans said ring member diametrically.

12. The percussion instrument recited in claim 1 wherein,
said resilient means includes at least two flexible strap members disposed transverse to each other at said hub means.

* * * * *